US008636024B2

(12) United States Patent
Isetani

(10) Patent No.: US 8,636,024 B2
(45) **Date of Patent: *Jan. 28, 2014**

(54) FUEL SUPPLY DEVICE

(75) Inventor: Junichi Isetani, Tokyo (JP)

(73) Assignee: Azbil Corporation, Tokyo (JP)

( * ) Notice: Subject to any disclaimer, the term of this patent is extended or adjusted under 35 U.S.C. 154(b) by 255 days.

This patent is subject to a terminal disclaimer.

(21) Appl. No.: 12/810,372

(22) PCT Filed: Jan. 7, 2009

(86) PCT No.: PCT/JP2009/050079
§ 371 (c)(1),
(2), (4) Date: Jun. 24, 2010

(87) PCT Pub. No.: WO2009/088016
PCT Pub. Date: Jul. 16, 2009

(65) Prior Publication Data

US 2010/0285414 A1 Nov. 11, 2010

(30) Foreign Application Priority Data

Jan. 8, 2008 (JP) ..... 2008-001167

(51) Int. Cl.
*F16K 31/12* (2006.01)

(52) U.S. Cl.
USPC ..... 137/486; 431/12; 431/90

(58) Field of Classification Search
USPC ..... 137/485–492; 431/12, 89, 90
See application file for complete search history.

(56) References Cited

U.S. PATENT DOCUMENTS 2,072,384 A * 3/1937 Schmidt ..... 137/6
4,961,348 A * 10/1990 Bonne ..... 73/861.02

(Continued)

FOREIGN PATENT DOCUMENTS

| | | | |
|---|---|---|---|
| JP | 8-94070 | A | 4/1996 |
| JP | 9-196367 | A | 7/1997 |
| JP | 2002-147752 | A | 5/2002 |
| JP | 2002-267157 | A | 9/2002 |
| JP | 2002-267159 | A | 9/2002 |
| JP | 2003-35612 | A | 2/2003 |
| JP | 2004-514138 | A | 5/2004 |
| JP | 2007-87029 | A | 4/2007 |
| WO | 02/40992 | A1 | 5/2002 |
| WO | 2007/036983 | A | 4/2007 |

OTHER PUBLICATIONS

Chinese Office Action dated Jun. 5, 2013, which issued during the prosecution of Chinese Patent Application No. 200980102101.7.

*Primary Examiner* — John Rivell
*Assistant Examiner* — R. K. Arundale
(74) *Attorney, Agent, or Firm* — Troutman Sanders LLP

(57) ABSTRACT

A fuel supply device for generating mixed gas in which air and/or oxygen are mixed into fuel gas and supplying the mixed gas to a burning appliance comprises a flow rate control module disposed in a supply path of the fuel gas and flow rate control modules disposed in supply paths of the air and/or the oxygen. The flow rate control module includes a thermal mass flow rate sensor, a first calculator for calculating the thermal flow rate of the fuel gas from the output of the thermal mass flow rate sensor, a control computing unit for controlling the flow rate of the fuel gas via a flow rate regulating valve according to the calculated thermal flow rate, a second calculator for calculating the calculated calorific value per unit volume of the fuel gas, and a computing unit for computing the ratio of the calculated calorific value to the reference calorific value per unit volume of the fuel gas in a reference state. The ratio is used for the control of the flow rates of the air and/or oxygen by the flow rate control modules.

5 Claims, 7 Drawing Sheets

(56) References Cited

U.S. PATENT DOCUMENTS 5,401,162 A * 3/1995 Bonne ..... 431/12
5,975,126 A * 11/1999 Bump et al. ..... 137/487.5
7,926,323 B2 4/2011 Ooishi et al.
2009/0277246 A1 11/2009 Ooishi et al.
2010/0269922 A1 * 10/2010 Isetani ..... 137/487.5

* cited by examiner

FUEL SUPPLY DEVICE

CROSS REFERENCE TO PRIOR APPLICATIONS

This application is a U.S. National Phase Application under 35 U.S.C. §371 of International Application No. PCT/JP2009/050079, filed on Jan. 7, 2009 and claims priority to Japanese Patent Application No. 2008-001167, filed on Jan. 8, 2008. The International Application was published in Japanese on Jul. 16, 2009 as WO 2009/088016 under PCT Article 21(2). All of the applications are herein incorporated by reference.

FIELD OF TECHNOLOGY

The present invention relates to a fuel supplying device capable of optimizing the mixing ratio of air and/or oxygen in a mixed gas based on a calorific value of a fuel gas when producing a mixed gas that is a mixture of air and/or oxygen in a fuel gas and supplying the mixed gas to a combusting device.

BACKGROUND OF THE INVENTION

When a fuel gas is combusted using a combusting device, such as a governor, prior to the fuel gas being fed to the governor, it is mixed with air and is fed to the governor as a mixed gas of the fuel gas and the air. The control of the air fuel ratio (A/F) for this mixed gas is indispensable in optimizing the mixed gas, or in other words, in optimizing the state of combustion of the fuel gas (to ensure the full combustion thereof).

This A/F ratio maintains the air/fuel ratio A/F at the uniform and ideal air/fuel ratio by measuring the fuel gas provision rate and the air provision rate (the mass flow) for the mixed gas, and adjusting the gas provision rate and the air provision rate based on the results of the measurement. (See, for example, Japanese Unexamined Patent Application Publication 2002-267159.) Thermal mass flow gauges, for example, may be used in the measurements of the amount of gas and air supplied.

On the other hand, when producing the mixed gas there are cases wherein various types of fuel gases having different compositions are used, or wherein there are differences in the composition even when the same type of fuel gas is used. In order to perform the A/F control under such circumstances, the calorific value of combustion in the fuel gas used or the calorific value per unit time is calculated and the calorific value of combustion or calorific value is fed back to the A/F control. (See, for example, Japanese Unexamined Patent Application Publication 2003-35612.)

Furthermore, in addition to air, oxygen may also be used when producing the mixed gas, and, in such a case, the mass flows of the fuel gas, the air, and the oxygen are each measured separately for the A/F control and the $O_2$/F control (abbreviated here as oxygen/fuel ratio control).

Note that when the burner uses a glass tube sealed process, high precision control is required for the amount of calorific value of the mixed gas, that is, of the fuel. In other words, while on the one hand the amount of fuel gas supplied is controlled based on the mass flow of the fuel gas, measured by a thermal mass flow gauge, as described above, on the other hand the amounts of air and/or oxygen supplied relative to the amount of fuel gas supplied is controlled so as to have the respective ideal mixtures of fuel gas, air, and/or oxygen in the mixed gas.

However, even when control is performed in this way, when there is a change in the composition of the fuel gas, then rather than maintaining the calorific value of the mixed gas that includes the fuel gas at a desired control value, or rather than maintaining the calorific value per unit time at a desired control value, conversely there is the danger that the air and/or oxygen mixing ratio relative to the fuel gas will vary due to the density of the fuel gas within the mixed gas varying as well, resulting in the danger of incomplete combustion of the fuel gas.

The object of the present invention is to provide a fuel supplying device capable of controlling the calorific value of a fuel gas, as a control value, and capable of optimizing the mixing ratio of air and/or oxygen in a mixed gas based on the calorific value of the fuel gas, notwithstanding differences or changes in the composition of the fuel gas.

SUMMARY OF THE INVENTION

The object as set forth above is achieved through the fuel supplying device as set forth in the present invention, where this fuel supplying device comprises a thermal mass flow rate sensor for measuring the mass flow rate of a fuel gas, disposed in a supply duct for the fuel gas; a first calculating portion for calculating a calorific flow rate for the fuel gas based on the output of the thermal mass flow rate sensor; a first flow rate adjusting device for adjusting the flow rate of the fuel gas so that the calorific flow rate calculated by the first calculating portion will match a control target value; a second calculating portion for calculating a calculated calorific value per unit volume of the fuel gas; and a calculating portion for calculating a ratio of the calculated calorific value to a reference calorific value per unit volume of the fuel gas at a reference condition; and a second flow rate adjusting device for adjusting an air flow rate and/or an oxygen flow rate, based on the ratio calculated by the calculating portion and on the flow rate of the fuel gas, disposed in a supply duct for air and/or a supply duct for oxygen. Specifically, the fuel gas is a hydrocarbon combustible gas.

The first calculating portion includes a map, produced through calculations in advance, of the relationship between the output of the thermal mass flow rate sensor and the calorific flow rate of the fuel gas. In this case, the first calculating portion can calculate the calorific flow rate of the fuel gas in accordance with the output of the thermal mass flow rate sensor based on the map.

Specifically, the second calculating portion includes another thermal-type sensor for calculating the calculated calorific value based on the output of the thermal-type in mass flow sensor when in a state wherein the flow of the fuel gas is stopped, or for calculating the calculated calorific value. Furthermore, the second calculating portion may calculate respective outputs from the thermal mass flow rate sensor at each level when the driving condition for the thermal mass flow sensor has changed to two levels, and calculates the calculated calorific value based on those outputs.

On the other hand, the second flow rate adjusting device optimizes the mix ratio of the air and/or oxygen in the mixed gas by correcting, based on the aforementioned ratio, the air and/or oxygen flow rate that is determined in accordance with a control target value for the fuel gas in order to achieve full combustion of the fuel gas.

The fuel providing device as set forth in the present invention focuses on the utility of the calorific flow rate of the fuel gas, defined as the product of the volumetric flow rate of the fuel gas and the calorific value per unit volume of the fuel gas, as a value for controlling the calorific value of the combustion of the fuel gas, and controls the flow rate of the fuel gas through a flow rate controlling valve so that the calorific flow rate matches a control target value by calculating the calorific flow rate of the fuel gas based on the output of a thermal mass flow sensor.

Additionally, the air and/or oxygen flow rate is corrected and controlled in accordance with a ratio of the calculated calorific value to a reference calorific value. Because of this, the mixing ratio of the air and oxygen in the mixed gas will be optimal even if the composition (type) of fuel gas is different from the desired composition (type), or if there is a change in the composition of the fuel gas itself. The result is that the fuel supplying device according to the present invention supplies a desired mixed gas stably, to achieve reliably full combustion of the fuel gas.

Furthermore, the calorific flow rate of the fuel gas can be calculated easily in accordance with the output of the thermal mass flow rate sensor from a map, reducing the load on the fuel supplying device regarding combustion control of the fuel gas.

BRIEF DESCRIPTION OF THE DRAWINGS

FIG. 4 is a graph illustrating the relationship between the gas density and the inverse ($1/\alpha$) of the thermal dispersion rate a.

DETAILED DESCRIPTION OF THE INVENTION

Figure 1:
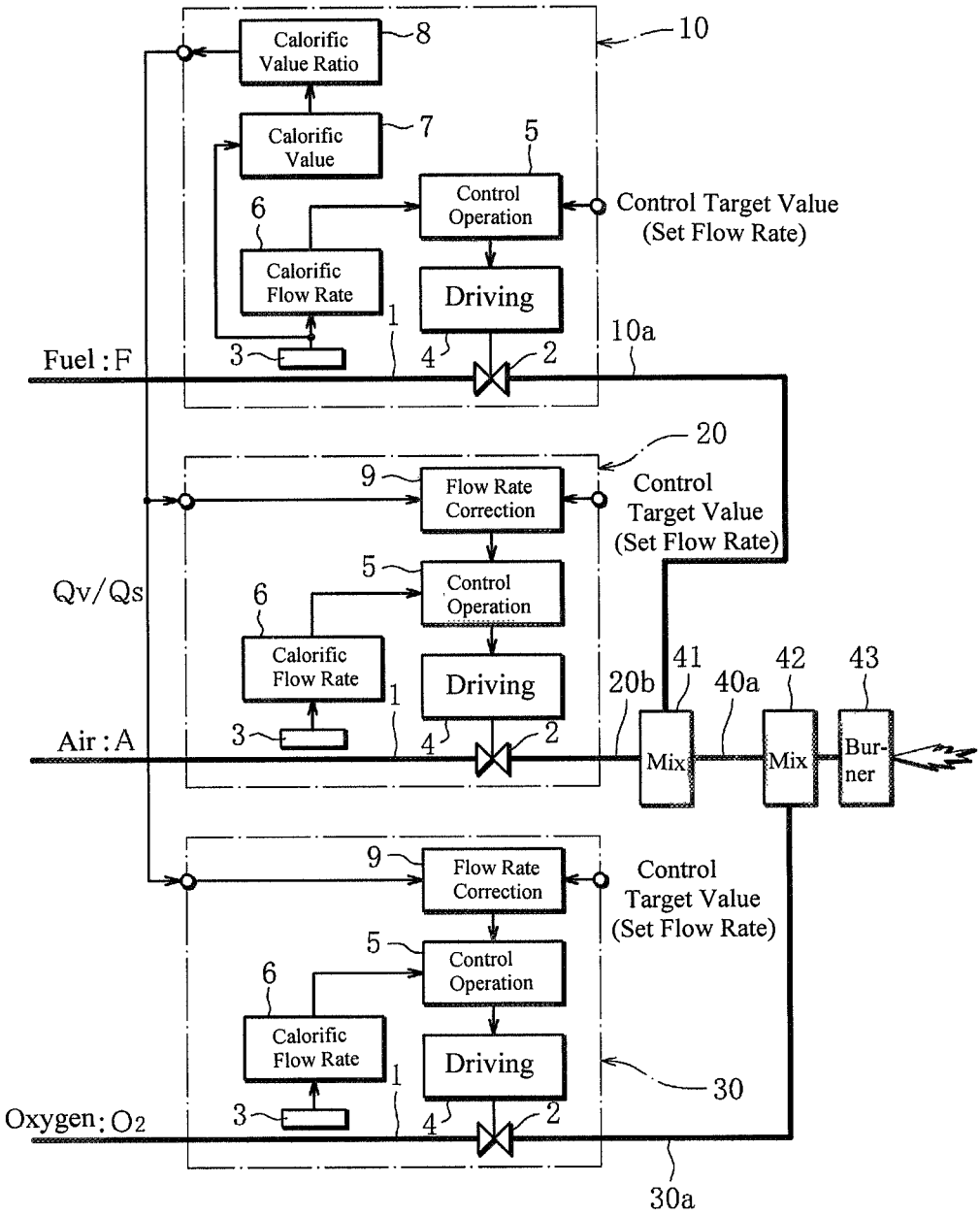
FIG. 1 is a diagram illustrating schematically a fuel supplying device as set forth in one example of embodiment.

As illustrated in FIG. 1, a fuel supplying device as set forth in one example of embodiment includes a flow rate controlling module 10 for controlling the provision rate of a fuel gas (F), a flow rate controlling module 20 for controlling the provision rate of air (A), and a flow rate controlling module 30 for controlling the supply rate of oxygen ($O_2$). These flow rate controlling modules 10, 20, and 30 are disposed, respectively, in a fuel gas supply duct 10*a*, an air supply duct 20*a*, and an oxygen supply duct 30*a*.

The supply duct 10*a* is connected through a mixing device 41 to the supply duct 20*a*, where this mixing device 41 is connected to the burner 43, as a combusting device, through a mixed gas supply duct 40*a*. On the other hand, the supply duct 30*a* is connected through the mixing device 42 to the supply duct 40*a*. Consequently, the fuel gas, the air, and the oxygen, having flow rates that are controlled, respectively, by the flow rate controlling modules 10, 20, and 30, are mixed sequentially by the mixing devices 41 and 42, and supplied to the burner 43 as a mixed gas.

The flow rate controlling module 20 controls the supply rate of the fuel gas in accordance with the calorific value of combustion required at the burner 43, and, on the other hand, the flow rate controlling modules 20 and 30 control the respective supply rates of the air and oxygen in accordance with the supply rate of the fuel gas in order to fully combust the fuel gas.

The specific structures for the flow rate controlling modules 10, 20, and 30 are illustrated schematically in FIG. 1 and FIG. 2; however, first the focus will be on the flow rate controlling module 10, and this module 10 will be explained below.

The flow rate controlling modules 10 comprises, fundamentally, a flow rate controlling valve (hereinafter termed simply a "valve") 2 for controlling the flow rate of a fuel gas within the supply duct 10*a*, a thermal mass flow rate thermal-type sensor (hereinafter termed a "sensor") 3 for detecting the mass flow rate of the fuel gas, a driving circuit 4 for driving the valve 2, to adjust the degree of opening of the valve 2, and a control processing unit 5 for controlling the driving circuit 4.

More specifically, the control processing unit 5 performs feedback control of the degree of opening of the valve 2, through the driving circuit 4, so as to eliminate the difference between the calorific flow rate calculated from the output (the mass flow rate) from the sensor 3, described below, and a control target value (a calorific flow rate) that is set in the control processing unit 5, to adjust the calorific flow rate of the fuel gas.

Figure 3:
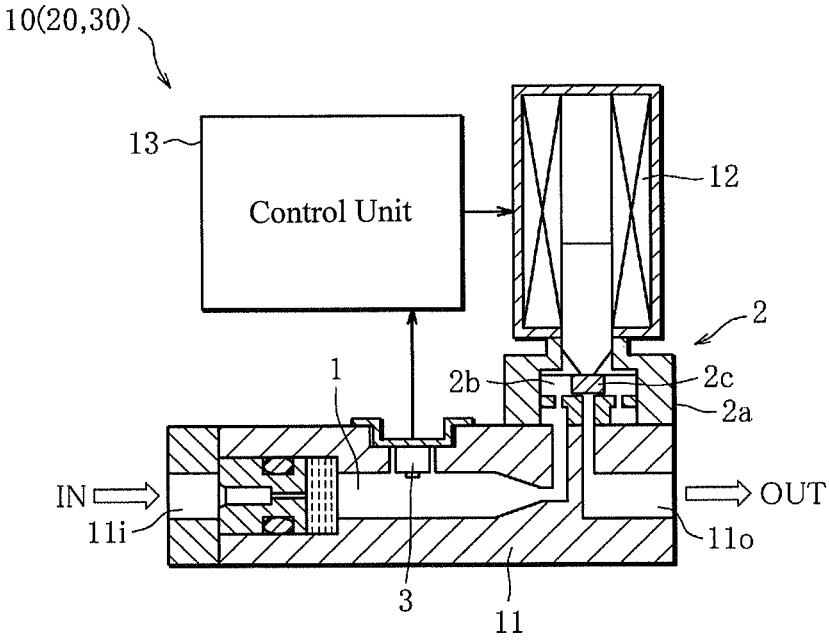
FIG. 3 is a diagram illustrating specifically a duct and a flow rate controlling valve in a flow rate controlling module.

FIG. 3 illustrates a specific structure for a flow rate controlling module 10.

The flow rate controlling module 10 has a pipe member 11, where the pipe member 11 forms a portion of the supplying path 10*a*, an inlet 111, and an outlet 110. The sensor 3, when viewed from the axial direction of the pipe member 11, is attached in the center thereof, and has a detecting surface that is exposed to the fuel gas within the pipe member 11.

The valve 2 includes a valve casing 2*a*, where the valve casing 2*a* is attached to the outer peripheral surface of the pipe member 11 in the vicinity of the outlet 110 of the pipe member 11. The valve casing 2*a* has a valve duct 2*b* that is provided on the inside thereof, where the valve duct 2*b* forms a portion of the interior flow path of the pipe member 11. Additionally, a valve unit 2*c* is disposed within the valve casing 2*a*, where the valve unit 2*c* is driven by a solenoid mechanism 12 to adjust the degree of opening of the valve flow path 2*b*, or in other words, of the valve 2. The solenoid mechanism 12 is attached on the outside of the valve casing 2*a*.

The flow rate controlling module further includes a controlling unit 13. The controlling unit 13 is also disposed on the outside of the pipe member 11, and has a control processing unit 5, a driving circuit 4, and the like.

Note that the pipe member 11, the valve 2, and the control unit 13 are all housed within a shared housing (not shown) of the flow rate controlling module 10.

The flow rate controlling modules 20 and 30 have identical structures to the flow rate controlling module 10, described above. Note that the details of the fundamental structure of the flow rate controlling module described above are already known.

The flow rate controlling modules 10, 20, and 30 according to the present invention or developed focusing on the output of the sensor 3 (the mass flow rate) being proportional to the calorific flow rate of the gasses to be controlled (the fuel gas, the air, and the oxygen).

Specifically, a sensor 3 that is used for detecting a mass flow rate Fm of a fluid comprises, for example, a heater for heating a gas in the vicinity of the detection, and two temperature sensors for detecting the temperature distribution of a heated gas, where the temperature difference detected by these temperature sensors is detected and outputted as the mass flow rate Fm. The temperature difference is produced through the temperature distribution of the fluid in the vicinity of the sensor changing depending on the flow of the fluid. Furthermore, the temperature distribution will vary depending on the heat dissipating rate a of the fluid and the flow speed (the volumetric flow rate Fv) of the fluid.

Note that the heat dissipating rate a of the fluid can be calculated according to Equation (1), below:

$$\alpha=\lambda/(\rho\times Cp) \quad (1)$$

where λ is the thermal conductivity of the gas, ρ is the density of the gas, and Cp is the specific heat of the gas.

On the other hand, the calorific value of the fuel gas can be expressed as the calorific value Qv per unit volume of the fuel gas, where this calorific value Qv will vary depending on the composition (type) of gas. For example, Table 1, below, shows, as gasses, hydrocarbon fuel gases, and the calorific values Qv for these fuel gases. Here the unit volume indicates the volume when the gas is in a reference condition (such as, 0° C.):

TABLE 1

| Composition of Fuel Gas | Product of the Calorific Value per Unit Volume |
|---|---|
| LNG (Liquefied Natural Gas) 45 MJ | 45.0 [MJ/m$^3$] |
| LNG (Liquefied Natural Gas) 65 MJ | 46.0 [MJ/m$^3$] |
| Methane ($CH_4$) 90% + Propane ($C_3H_8$): 10% | 46.1 [MJ/m$^3$] |
| Methane ($CH_4$) 90% + Butane ($C_4H_{10}$): 10% | 49.3 [MJ/m$^3$] |

As is clear from Table 1, the calorific value Qv by the fuel gas varies depending on the type, or composition, of the fuel gas. The differences between the calorific values Qv is primarily caused by differences in the density ρ that is determined by the composition of the gas. Consequently, when there is a change in the composition of the fluid that is subject to detection by the sensor 3, there will also be a change in the density ρ of the fluid. In this sense, the change in the density ρ in this way changes the mass flow rate Fm that is detected by the sensor 3.

Figure 4:
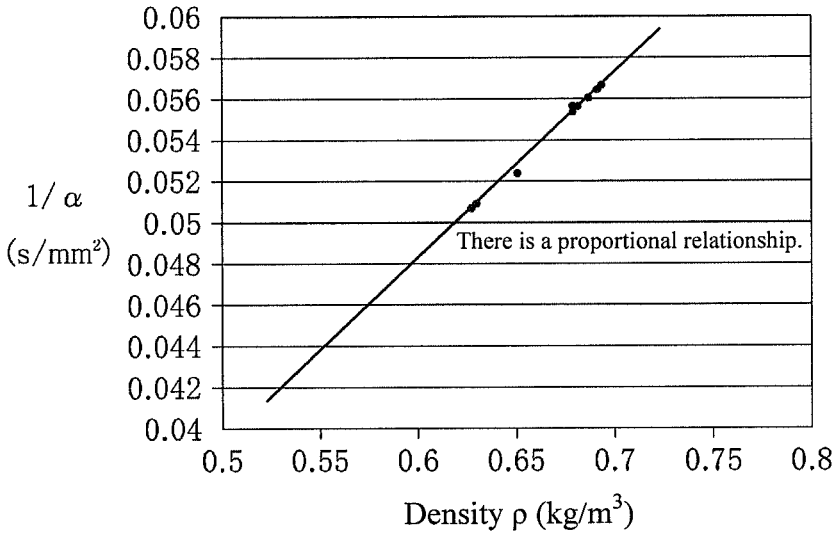

On the other hand, FIG. 4 illustrates the relationship between the density ρ of the gas and the inverse (=1/α) of the heat dissipating rate α, described above. As is clear from FIG. 4, the density ρ of the gas is proportional to the inverse of the heat dissipating rate α. That is, the relationship between the density ρ and the heat dissipating rate α is expressed by Equation (2), below:

$$1/\alpha=K1\times\rho \quad (2)$$

Here K1 is a proportionality constant.

The proportional relationship in Equation (2) applies regardless of differences in the composition of the gas.

Figure 5:
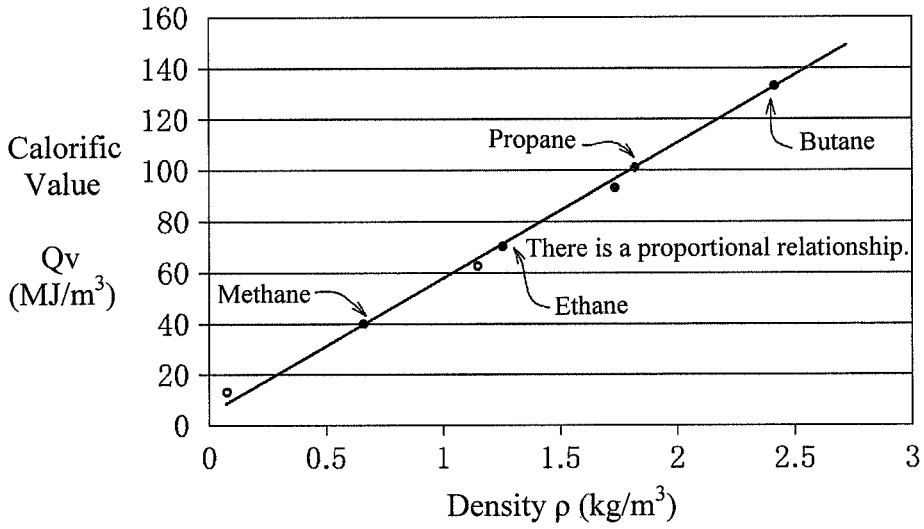
FIG. 5 is a graph illustrating the relationship between the gas density and the calorific value per unit volume.

Additionally, FIG. 5 illustrates the relationship between the density ρ of the gas and the calorific value Qv. As is clear from FIG. 5, the calorific value Qv is proportional to the density ρ of the gas. That is, the relationship between the calorific value Qv and the density ρ is expressed by Equation (3), below:

$$Qv=K2\times\rho \quad (3)$$

Here K2 is a proportionality constant.

The proportional relationship in Equation (3) applies regardless of differences in the composition of the gas.

As is clear from Equations (2) and (3), because of the mutual relationships between the inverse of the heat dissipating rate α and the calorific value Qv, the temperature distribution in the gas in the vicinity of the sensor 3 can also be said to vary with the volumetric flow rate Fv and the calorific value Qv of the gas.

This indicates that, regardless of the composition of the gas, the output of the sensor 3 (the mass flow rate Fm) is proportional to the calorific value Qv of the gas, and, at the same time, is also proportional to the flow rate (volumetric flow rate) Fv of the gas as well.

Figure 6:
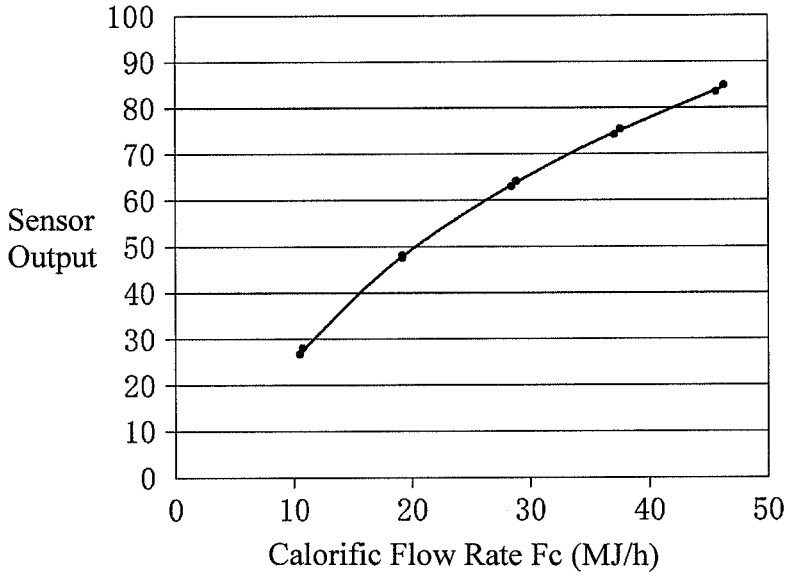
FIG. 6 is a graph illustrating the relationship between the calorific flow rate of the fuel gasses and the outputs of a thermal-type sensor.

Here the present inventors discovered that if a calorific flow rate Fc is defined as the product of the calorific value Qv of the gas and the flow rate (volumetric flow rate) Fv, then the calorific flow rate Fc and the output of the thermal mass flow sensor 3 (the mass flow rate Fm) will have a single relationship as illustrated in FIG. 6.

Figure 2:
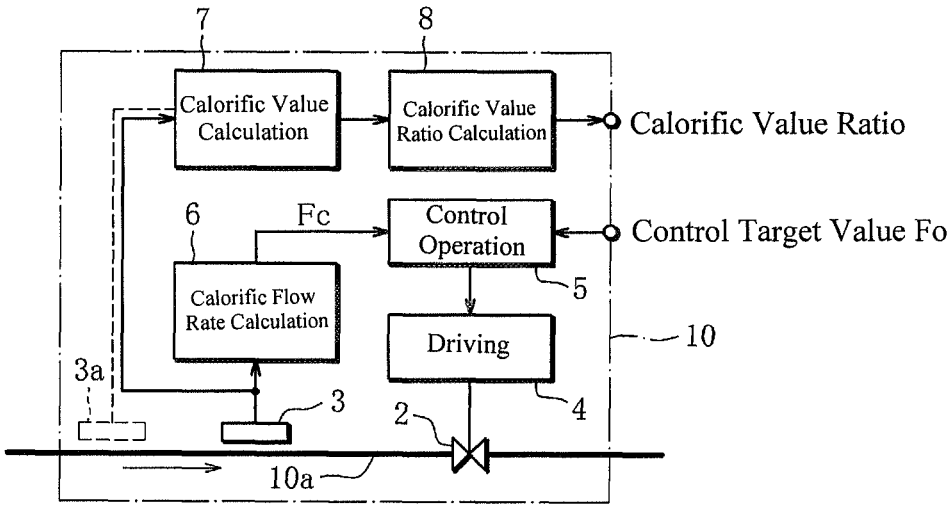
FIG. 2 is a diagram illustrating schematically a flow rate controlling module used in the flow rate control of the fuel gas in FIG. 1.

Because of this, the flow rate controlling modules 10, 20, and 30 as set forth in the present invention, as is clear from FIG. 2, is further provided with a calculating portion 6 that not only calculates the mass flow rate Fm of the gas, as the output of the sensor 3, but also a calorific flow rate Fc based on the output of the sensor 3 (the mass flow rate Fm). Specifically, the calculating portion 6 has a memory wherein is stored the map illustrated in FIG. 6, for reading out the calorific flow rate Fc in accordance with the output, based on the output from the sensor 3 (the mass flow rate Fm), to provide the read-out calorific flow rate Fc to the control processing unit 5. Note that the map in FIG. 6 is created through calculating in advance the calorific flow rates Fc corresponding to the outputs of the sensor 3.

A control target value Fo is applied to the control processing unit 5, where this control target value Fo is the flow rate, that is, the calorific flow rate, of the gas that is to be supplied from the corresponding flow rate controlling module. The control processing unit 5 calculates the difference between the control target value Fo and the calorific flow rate Fc provided from the calculating portion 6, to control the degree of the opening of the valve 2, through the driving circuit 4, so that the difference will go to zero.

Because of this, even if there were to be a change in the composition of the fuel gas, the flow rate controlling modules 10, 20, and 30 would still be able to control the flow rate (the calorific value Qv) of the gases to match the control target value Fo, enabling the gases to be supplied stably with a desired calorific flow rate Fc.

In more detail, in a typical conventional flow rate controlling module, the mass flow rate of the gas would be controlled based on the output of the sensor 3 (the mass flow rate Fm). However, in the flow rate controlling module according to the present invention, the focus is on the calorific value Qv of the gas, and a calorific flow rate Fc is calculated based on the output of the sensor 3, to control directly the calorific flow rate (the calorific value) itself of the gas. Because of this, even if there were a change in the mass flow rate and/or the composition of the gas, still the flow rate controlling module according to the present invention would be able to control uniformly the calorific flow rate Fc (the calorific value) of the gas supplied from the flow rate controlling module, through controlling the degree of the opening of the valve 2.

The result is that, for the flow rate controlling module according to the present invention, there is no need to determine whether a factor that is causing a change in the output of the sensor 3 is a change in the mass flow rate of the gas or a change in the composition of the gas, but rather the flow rate controlling module can perform the flow rate control for the gas with stability.

Note that in order to combust completely and with stability the fuel gas, that is, the mixed gas, described above it is necessary to produce a mixed gas wherein an appropriate proportion of air or oxygen is mixed into the fuel gas. Normally the ideal air/fuel ratio (A/F) or ideal oxygen/fuel ratio ($O_2$/F) is as illustrated in Table 2, below, when the hydrocarbon fuel gas is combusted completely:

TABLE 2

| Fuel Gas | A/F | $O_2$/F |
|---|---|---|
| Methane ($CH_4$) | 9.52 | 2.0 |
| 13A (LNG) | 11.0 | 2.3 |
| Ethane ($C_2H_6$) | 16.7 | 3.5 |
| Propane ($C_3H_8$) | 13.8 | 5.0 |
| Butane ($C_4H_{10}$) | 30.9 | 6.5 |

When there is a change in the type or composition of the fuel gas, the A/F and $O_2$/F will also change, and thus in order to completely combust the fuel gas, that is, the mixed gas, it is necessary to adjust the flow rate of the air and/or the oxygen in the mixed gas depending on the composition and flow rate of the fuel gas within the mixed gas.

Because of this, in the case of the fuel supplying device as set forth in the present example of embodiment, the flow rate controlling module 10 controls the flow rate of the fuel gas based on the calorific flow rate Fc of the fuel gas. Additionally, the flow rate controlling module 10 calculates the calorific value Qv per unit volume of the fuel gas supplied through the module 10, and calculates the ratio of the calorific value Qv relative to the calorific value Qs per unit volume of the fuel gas when in the reference state. This type of ratio Qv/Qs is an indicator indicating the degree of change in the calorific value Qv. The primary cause for a change in the calorific value Qv is a change in the composition of the fuel gas.

On the other hand, the flow rate controlling modules 20 and 30, when controlling the flow rates of the hair and the oxygen, each perform corrections of the flow rates of the air and oxygen provided through the flow rate controlling modules 20 and 30 in accordance with the ratio Qv/Qs. The result is that the mixed ratio of the air and oxygen into the mixed gas that is applied to the burner 43 is controlled so as to be optimal.

In order to calculate the ratio Qv/Qs, the flow rate controlling module 10, as illustrated in FIG. 2, also includes a calculating portion 7 and a calculating portion 8. The calculating portion 7 calculates the calorific value Qv per unit volume of the fuel gas based on the output of the sensor 3 when the flow of the fuel gas is in a stopped state. Because of this, the valve 2 is closed to stop the flow of the fuel gas prior to the calculating portion 7 calculating the calorific value Qv. When in this state, the calculating portion 7 receives the supply of the output from the sensor 3, and, based on this output, calculates the mass, or in other words, the density ρ, of the fuel gas. More specifically, as is clear from Equation (3), because the fuel gas density ρ and calorific value Qv have a proportional relationship, the calculating portion 7 can calculate the calorific value Qv based on the density ρ based on this proportional relationship.

The calculating portion 8 calculates Qv/Qs based on the calorific value Qv, calculated by the calculating portion 7, and a known calorific value Qs. The calorific value Qs indicates the calorific value per unit volume when the fuel gas is in a reference condition (for example, at 0° C.). Specifically, the calorific value Qs is calculated in advance for each type of fuel gas, and these calorific values Qs are stored in a table in a memory (not shown) in the calculating portion 8. Because of this, the calculating portion 8 is able to select, from the table, the calorific value Qs corresponding to the fuel gas that is subject to control, and to calculate the ratio Qv/Qs based on the selected calorific value Qs.

On the other hand, as illustrated in FIG. 1, the flow rate controlling modules 20 and 30 also each include a flow rate correcting portion 9. These flow rate correcting portions 9 correct the control target values, or in other words, the respective control rates of the air and the oxygen, in accordance with the ratio Qv/Qs supplied from the flow rate controlling module 10.

That is, the control target values (set flow rates) for the flow rate controlling modules 20 and 30 are determined based on the control target value (set flow rate) for the flow rate controlling module 10 so as to optimize the mixing ratio of the air and the oxygen in the mixed gas, thus correcting the control target values for the flow rate controlling modules 20 and 30 in accordance with the ratio Qv/Qs, enables the full combustion of the mixed gas, or in other words, the fuel gas.

Specifically, if, for example, the ratio Qv/Qs of the fuel gas is 1.1, then it is determined that the calorific value of the fuel gas has increased by 10% due to a change in composition of the fuel gas. In this case, the supply rates of the air and the oxygen required for full combustion of the fuel gas have each increased by 10%.

Given the fuel supplying device as set forth above, the supply rate for the fuel gas is controlled based on the calorific flow rate of the fuel gas, and thus regardless of the composition of the fuel gas, it is still possible to maintain the calorific value of combustion of the fuel gas precisely at the control target value.

Because of this, even if there is a change in the fuel gas from the desired composition, or even if a situation occurs wherein the calorific value Qv of the fuel gas is different from the required calorific value, the flow rate of the air and of the oxygen will be corrected in accordance with the ratio Qv/Qs, and thus the mixing ratio of the air and of the oxygen in the mixed gas will be optimal for the composition (the calorific value) of the fuel gas. The result is that that it is possible to achieve not only full combustion of the fuel gas, but also the optimization of the combustion temperature and the state of the flame.

The present invention is not limited to the example of embodiment set forth above, but rather may be modified in a variety of ways. For example, the flow rate control of the air and the oxygen may use techniques, as described below, which are different from the techniques that are described above.

First, when the flow rate controlling module 10 calculates the ratio Qv/Qs and the calorific flow rate Fc for the fuel gas, the fuel supplying device may calculate flow rates for the air and the oxygen for achieving the optimal mixing ratio of the air and the oxygen in the mixed gas based on the ratio Qv/Qs and the calorific flow rate Fc, and may use these flow rates as the control target values (set flow rates) for the flow rate controlling modules 20 and 30.

In the case of the flow rate controlling modules 10, 20, and 30 as set forth in the first example of embodiment, it is necessary to perform an operation to close the valve 2, that is, to stop the flow of the fuel gas within the supply duct, when calculating the calorific value Qv of the fuel gas.

However, it is possible for the flow rate calculating module to include also a reservoir chamber for holding the fuel gas, without producing a flow in the fuel gas, within the pipe member 11, and a calorific sensor 3*a* (illustrated in FIG. 2), separate from the aforementioned sensor 3, disposed in that reservoir chamber. In this case, it is possible for the calculating portion 72 calculate the calorific value Qv per unit volume of the gas based on the output of the sensor 3*a* in a state wherein the gas is flowing.

Figure 7:
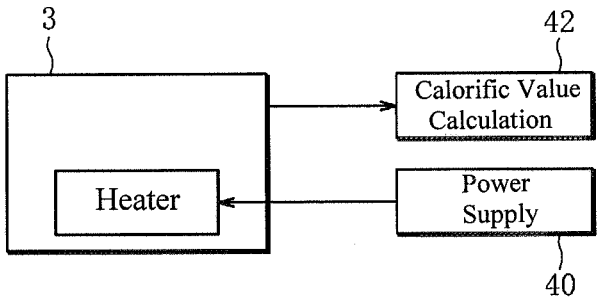
FIG. 7 is a diagram illustrating a modified example of a calculating portion for calculating the calorific value in the fuel gas.

Additionally, the flow rate controlling module as illustrated in FIG. 7 may include, instead of the calculating portion 7, a parameter controlling portion 30 that can switch, between two levels, a temperature parameter (the difference between the fuel gas temperature and the heater temperature), for the heater, which is a driving condition for the sensor 3, and may be provided with a calculating portion 42 for calculating the calorific value Qv based on the output from the sensor 3 under these driving conditions.

Additionally, as disclosed in, for example, Japanese Examined Patent Application Publication 2004-514138, when used as a thermal mass flow rate sensor of a type wherein the mass flow rate Fm is calculated from the heater driving current when the heater temperature is maintained at a constant value, the calorific value Qv may be calculated based on the outputs of the sensor 3 at each level when the heater temperature is switched between the two levels.

Specifically, the calculating portion 42 may calculate a thermal conductivity $\lambda$ of the fuel gas based on a difference in the outputs of the sensors 3, and may calculate the calorific value Qv in accordance with the proportionality relationship between the thermal conductivity $\lambda$ and the density $\rho$ of the gas (referencing the aforementioned Equation (3)).

The flow rate controlling module according to the present invention is also able to output the calorific flow rate Fc, calculated by the calculating portion 6, and the output of the sensor 3 (the mass flow rate Fm) in parallel.

Furthermore, the flow rate controlling device according to the present invention may select either flow rate control of the fuel gas based on the calorific flow rate Fc or flow rate control of the fuel gas based on the mass flow rate.

Furthermore, if it is possible to assume that the air and oxygen constituents (composition) will remain constant, then the flow rate controlling modules 20 and 30 can control the flow rates of the air and the oxygen based on mass flow rates.

The fuel supplying device may produce a mixed gas by mixing either air or oxygen into the fuel gas.

Additionally, the fuel supplying device may be structured as a single assembly contained within a housing shared with a microcomputer for controlling the flow rate controlling modules 10, 20, and 30, and this module. In this case, the microcomputer controls the operations of the various flow rate controlling modules in relation to each other. Furthermore, the sensors 3 for the various flow rate control modules may include known temperature correcting circuits.

What is claimed is:

1. A fuel supplying device for supplying, to a combustion device, a mixed gas wherein at least one of air and oxygen are mixed into a fuel gas, comprising: a thermal mass flow rate sensor measuring a mass flow rate of a fuel gas, disposed in a supply duct for the fuel, and outputting an output that corresponds to a temperature distribution of the fuel gas, which varies depending on a heat dissipating rate of the fuel gas and a volumetric flow rate, in a vicinity of the thermal mass flow rate sensor; a first calculating portion calculating a calorific flow rate for the fuel gas based on the output, which is calculated from the temperature distribution of the fuel gas in the vicinity of the thermal mass flow rate sensor, from the thermal mass flow rate sensor, a proportional relationship between an inverse of the heat dissipating rate of the fluid gas and a density of the fuel gas, and a proportional relationship between the calorific value per unit volume of the fuel gas and the density of the fuel gas; a first flow rate adjusting device adjusting the flow rate of the fuel gas so that the calorific flow rate calculated by the first calculating portion will match a control target value; a second calculating portion calculating a calculated calorific value per unit volume of the fuel gas; a calculating portion calculating a ratio of the calculated calorific value to a reference calorific value per unit volume of the fuel gas at a reference condition; and a second flow rate adjusting device adjusting at least one of an air flow rate and an oxygen flow rate, based on the ratio calculated by the calculating portion and on the flow rate of the fuel gas, disposed in at least one of a supply duct for air and a supply duct for oxygen, wherein the first calculating portion includes a map that is produced through calculating in advance a single relationship between the output of the thermal mass flow sensor and the calorific mass flow of the fuel gas, the fuel gas is a hydrocarbon combustible gas, and the single relationship applies to a plurality of compositions of the fuel gas.

2. The fuel supplying device according to claim 1, wherein: the second calculating portion calculates the calculated calorific value based on the output of the thermal sensor when in a state wherein the flow of the fuel gas is stopped.

3. The fuel supplying device according to claim 1, wherein: the second calculating portion includes a calorific sensor calculating the calculated calorific value.

4. The fuel supplying device according to claim 1, wherein: the second calculating portion calculates respective outputs from the thermal mass flow rate sensor when the driving condition for the thermal mass flow sensor has changed, and calculates the calculated calorific value based on those outputs.

5. The fuel supplying device according to claim 1, wherein: the second flow rate adjusting device corrects, in accordance with the ratio, at least one of the air and oxygen flow rates determined in accordance with the control target value for the fuel gas for achieving full combustion of the fuel gas, to optimize the mixing ratio of at least one of the air and oxygen in the mixed gas.

* * * * *